United States Patent [19]

Naylor

[11] 3,935,989

[45] Feb. 3, 1976

[54] FOLDABLE CARTON TRAY

[75] Inventor: Kenneth Naylor, Bradford, England

[73] Assignee: Alf Cooke Limited, England

[22] Filed: Dec. 28, 1973

[21] Appl. No.: 429,081

[52] U.S. Cl. ..... 229/31 R; 229/41 B
[51] Int. Cl. ..... B65d 5/24
[58] Field of Search ..... 229/31 R, 30, 41 B, 34 A

[56] References Cited

UNITED STATES PATENTS

| | | | |
|---|---|---|---|
| 1,656,307 | 1/1928 | Walter | 229/41 B |
| 1,760,325 | 5/1930 | Smull | 229/41 B |
| 2,330,521 | 9/1943 | Scheide | 229/31 R |
| 3,734,391 | 5/1973 | Munizza | 229/31 R |

*Primary Examiner*—John W. Huckert
*Assistant Examiner*—Edward J. McCarthy
*Attorney, Agent, or Firm*—Louis Orenbuch

[57] ABSTRACT

A foldable carton tray and a blank therefor which is formed with longitudinal and lateral fold lines parallel to the boundaries of the blank to delineate respectively side and end panels connected by corner panels and all surrounding a centre panel, each end panel having diagonal fold lines extending from the adjacent intersections of said longitudinal and lateral fold lines towards but stopping short of the edge of said panel to delineate a first trapezoidal shaped flap with a tongue extension formed by two cut extensions of said diagonal fold lines opening into said edge, and the centre panel having three cut lines near each end to delineate at each end a second trapezoidal shaped flap which has a common base with said first flap and is complementary to the latter.

The blank is preferably constructed so that at each end downward folding of said first trapezoidal shaped flap at 90° to the centre panel causes the adjacent corner panels to swing round to the carton end and causes the second trapezoidal shaped flap to swing into a vertical position to complete the carton end wall.

1 Claim, 3 Drawing Figures

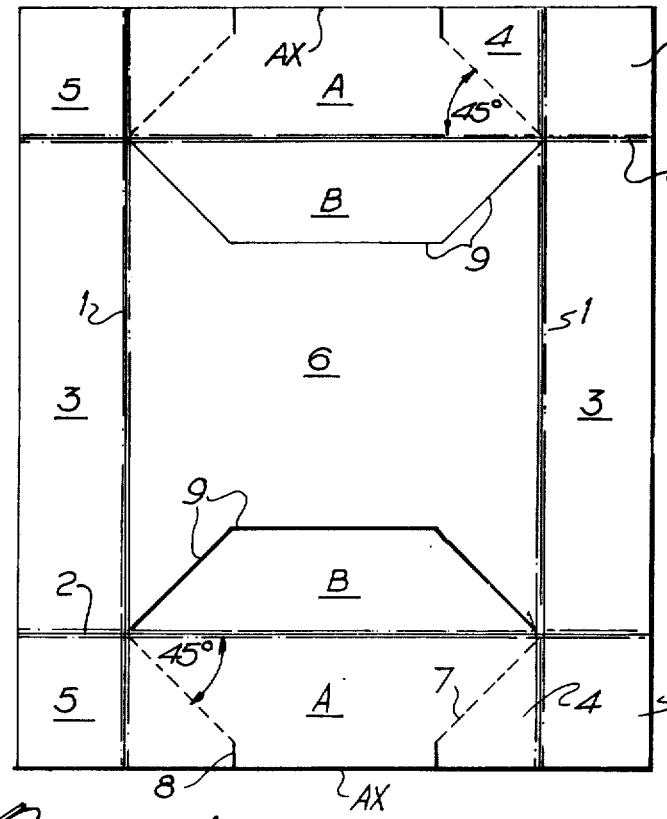
FIG 1
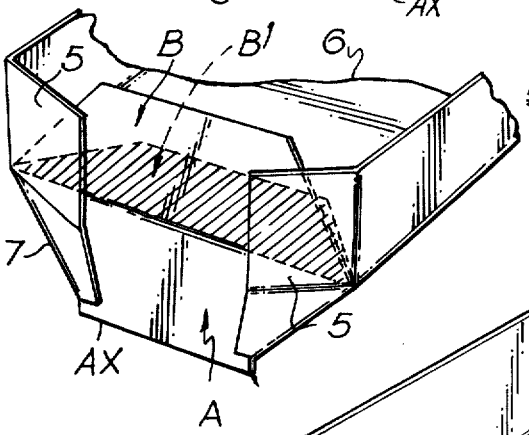
FIG. 2
FIG. 3
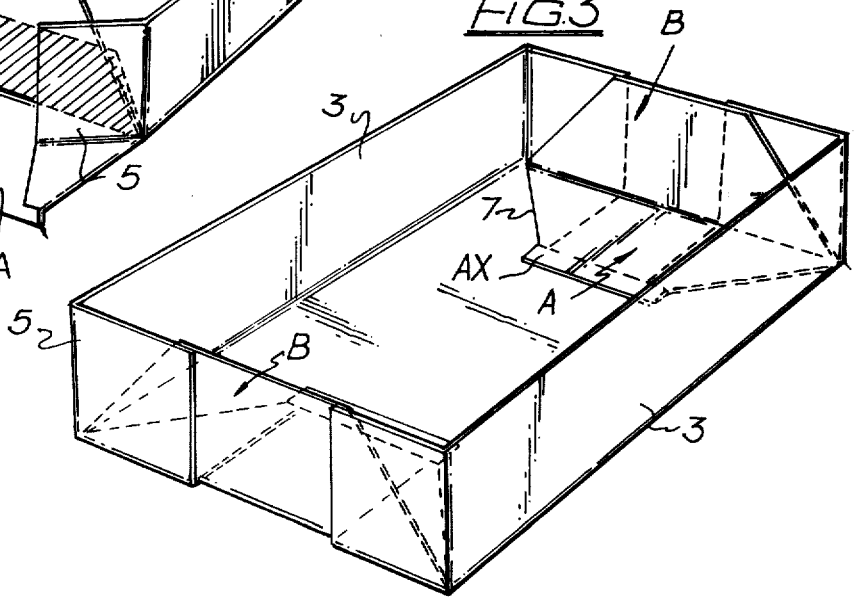

FOLDABLE CARTON TRAY

This invention relates to a foldable carton tray which can be quickly erected from a blank. The tray may be particularly suitable for shrink-wrapping of goods, placed in the tray, for example, light merchandise such as fruit and vegtables, but its use is not limited to this. The tray being erectable from a blank has the advantage that it can be delivered and stored in its flat state, thereby saving transport costs and storage space, and it can easily be erected by hand as an alternative to machine erection.

According to the invention there is provided a tray blank of cardboard or like sheet material which is formed with longitudinal and lateral fold lines parallel to the boundaries of the blank to delineate respectively side and end panels connected by corner panels and all surrounding a centre panel, each end panel having diagonal fold lines extending from the adjacent intersections of said longitudinal and lateral fold lines towards but stopping short of the edge of said panel to delineate a first trapezoidal shaped flap with a tongue extension formed by two cut extensions of said diagonal fold lines opening into said edge, and the centre panel having three cut lines near each end to delineate at each end a second trapozoidal shaped flap which has a common base with said first flap and is complementary to the latter.

This blank being rectangular and not having any portions cut away can provide an economical production with no wastage of material and it can be erected and locked in its tray form quickly and easily as will now be explained with the aid of the accompanying drawings, wherein:

FIG. 1 shows by way of example one form of tray blank according to the invention;

FIG. 2 illustrates an intermediate stage in the erection of one end of a tray from the blank of FIG. 1; and FIG. 3 illustrates the completely erected tray.

In the following description as well as in the preceding statement of invention and the ensuing Claims, it has been assumed that the blank has a greater longitudinal dimension than its lateral one, but a square blank can equally well be used and it is to be understood that a square blank is to be included within the scope of said Claims.

The blank shown in FIG. 1 has longitudinal and lateral scored lines 1, 2 forming side and end panels 3, 4 and corner panels 5 around a centre panel 6. In each end panel 4 diagonal scored lines 7 terminating in cuts 8 opening into the edge of the panel form a flap A with a locking tongue AX. A complementary flap B is severed by cut lines 9 from each end of the body panel 6 but left attached to the adjacent end panel 4 along the scored line 2.

The method of erection is illustrated partly by FIG. 2 and finally by the finished tray in FIG. 3. First the side panels are folded up at right angles to the centre panel, then each end is dealt with separately, as follows. Flap A is folded down through 90° swinging the corner panels round to the carton end and swinging flap B into a vertical position to complete the carton end wall with the corner panels. This position is almost reached in FIG. 2. Flap A is then folded through a further 90° to occupy the spaced indicated by FIG. 2. by the shaded area B′ in the centre panel vacated by flap B, the tongue AX being forced up to lie above the edge of the centre panel to thereby lock that end of the carton in its erected condition.

A similar operation at the other end completes the erection of the tray which has solid corners giving the tray considerable rigidity and rendering it very suitable for use in shrink-wrapping.

Of course, if erection of the tray is done by machine, the two ends could be dealt with simultaneously.

I claim:

1. A carton tray blank of cardboard or like sheet material which is formed with longitudinal and lateral fold lines parallel to the boundaries of the blank to delineate respectively side and end panels connected by corner panels and all surrounding a center panel, each end panel having diagonal fold lines extending from the adjacent intersections of said longitudinal and lateral fold lines towards but stopping short of the edge of said panel to delineate a first trapezoidal flap with a tongue extension formed by cuts extending from said diagonal fold lines to said edge, the center panel having three cut lines near each end to delineate at each end a second trapezoidal flap having a common base with said first flap and being complementary to the latter, the blank being erectable by folding the side panels up at 90° to the center panel, then at each end downwardly folding said first flap at 90° to the center panel so that the adjacent corner panels swing around to the carton's end, swinging said second flaps up into the vertical position to abut the corner panels whereby the end walls are formed, and folding said first flaps further to cause them to occupy the spaces vacated by the second flaps, with the tongue extension overlapping the center panel and locking the first flaps in positions providing a complete bottom for the carton.

* * * * *